US006266888B1

(12) United States Patent
Zowaski

(10) Patent No.: US 6,266,888 B1
(45) Date of Patent: Jul. 31, 2001

(54) REACHING RAZOR

(76) Inventor: Thomas E. Zowaski, 21 Peachtree La., Goshen, NY (US) 10924

( * ) Notice: Subject to any disclaimer, the term of this patent is extended or adjusted under 35 U.S.C. 154(b) by 0 days.

(21) Appl. No.: 09/525,500

(22) Filed: Mar. 15, 2000

(51) Int. Cl.[7] ..... B26B 21/14
(52) U.S. Cl. ..... 30/527; 30/526
(58) Field of Search ..... 30/32, 50, 526, 30/527, 537

(56) References Cited

U.S. PATENT DOCUMENTS

| | | | | |
|---|---|---|---|---|
| D. 404,486 | * | 1/1999 | McCool et al. | D24/146 |
| 2,844,870 | * | 7/1958 | Roces et al. | 30/526 |
| 4,845,848 | * | 7/1989 | Strickland | 30/32 |
| 4,905,372 | * | 3/1990 | Willis | 30/526 |
| 4,955,136 | * | 9/1990 | Diaz-Rivera | 30/32 |
| 5,167,069 | * | 12/1992 | Quinn | 30/527 |
| 5,600,887 | * | 2/1997 | Olson | 30/527 |
| 5,628,759 | * | 5/1997 | McCool et al. | 30/32 |
| 5,674,234 | * | 10/1997 | McCool et al. | 30/32 |
| 5,687,485 | * | 11/1997 | Shurtleff et al. | 30/526 |
| 5,704,127 | * | 1/1998 | Cordio | 30/526 |
| 5,787,586 | * | 8/1998 | Apprille, Jr. et al. | 30/50 |
| 5,822,869 | * | 10/1998 | Metcalf et al. | 30/526 |
| 5,911,480 | * | 6/1999 | Morgan | 30/526 |
| 6,189,222 | * | 2/2001 | Doyle | 30/526 |

FOREIGN PATENT DOCUMENTS

| | | | | |
|---|---|---|---|---|
| 274299 | * | 7/1927 | (GB) | 30/FOR 100 |

* cited by examiner

*Primary Examiner*—Hwel-Slu Payer
(74) *Attorney, Agent, or Firm*—John D. Gugliotta

(57) ABSTRACT

A reaching razor is provided having a head portion, a handle and an elongated, flexible neck having a head attachment end opposite a handle attachment end, In this manner the head portion is affixed to the head attachment end and the handle is attached to the handle attachment end such as to as allow the user the ability to articulate the head attachment end in relation to the handle attachment end fully about the lateral centerline of the handle.

1 Claim, 2 Drawing Sheets

REACHING RAZOR

BACKGROUND OF THE INVENTION

1. Field of the Invention

The present invention relates generally to shaving devices and, more particularly, to an extended shaft reaching razor.

2. Description of the Related Art

In the related art, the following patents disclose a razor having an extendible handle with adjustable positions.

U.S. Pat. No. 5,911,480 issued in the name of Morgan

U.S. Pat. No. 5,687,485 issued in the name of Shurtileffet al.

The following patents describe a razor handle with an elongated hand gripping structure.

U.S. Pat. No. 5,822,869 issued in the name of Metcalf et al.

U.S. Pat. No. 5,787,586 issued in the name of Apprille et al.

The following patents disclose the design and function of a flexible surgical razor.

U.S. Pat. No. 5,674,234 issued in the name of McCool et al.

U.S. Patent No. 5,628,759 issued in the name of McCool et al.

U.S. Pat. No. D 404,486 issued in the name of McCool et al.

U.S. Pat. No. 5,600,887 issued in the name of Olson describes a flexible razor with an elongated handle.

U.S. Pat. No. 4,845,848 issued in the name of Strickland discloses a flexible razor blade mounted on a flexible holder.

Consequently, a need has therefore been felt for an improved but less complex mechanism to provide for extended reach shaving devices.

SUMMARY OF THE INVENTION

Therefore, it is an object of the invention to indicate a device of the type disclosed above which avoids the disadvantages inherent in the state of the art. In particular, the device is to be an apparatus to aid in the shaving of hard to reach areas of the body. It is intended for shaving areas such as the back, legs and the like. The handle of the invention consists of a cushioned hand grip similar to that which might be found on a bicycle. This ensures that the invention is not only comfortable to hold, but less likely to slip and fall as well. The handle of the invention, approximately 24 inches long would be made of a flexible metal gooseneck hose, similar in nature to a flexible gas line connection or a flexible gooseneck microphone holder on a podium. This allows the invention to be bent and shaped into the ideal shape to allow various body locations to be reached. At the opposite end of the handle is a disposable razor holder that would be attached via an epoxy adhesive or similar type connection. The holder would be capable of accepting standard replacement shaving blades or cartridges.

To use the invention, the user would simply apply shaving cream or gel, bend the handle of the invention into a shape that facilitates the shaving of that particular area, and begin shaving.

The use of the present invention allows anyone to shave their back while in a shower in a quick, easy and effective manner and allows the elderly or disabled to shave their legs as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
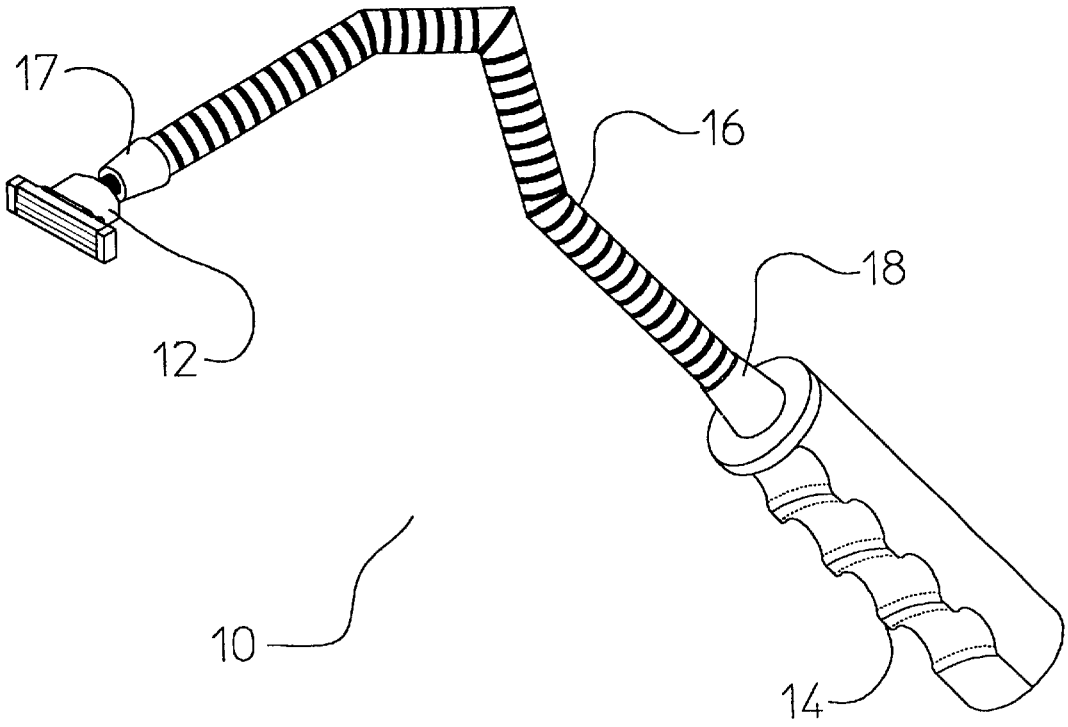
FIG. 1 is a perspective view of an extended reaching razor according to the preferred embodiment of the present invention.

Referring now to the figures, a reaching razor 10 is shown, according to the present invention, having a head portion 12, a handle 14, and an elongated, flexible neck 16 having a head attachment end 17 opposite a handle attachment end 18. The head portion 12 is affixed to the head attachment end 17 as will be described in greater detail below in reference to FIG. 3. Although it is envisioned that a variety of otherwise conventional attachment means can accomplish the attachment of the handle 14 to the handle attachment end 18 of the neck 16 and still remain in accordance with the teachings of the present invention, for purposes of disclosure of the best mode of the invention it is presently considered that a rigid attachment of the handle 14 to the neck 16 at the handle attachment end 18 in a fixed manner would embody the preferred teachings of the present invention. Although various handle designs can be accommodated, it is envisioned that the handle 14 is merely functioning as a dextrous gripping surface.

Figure 2:
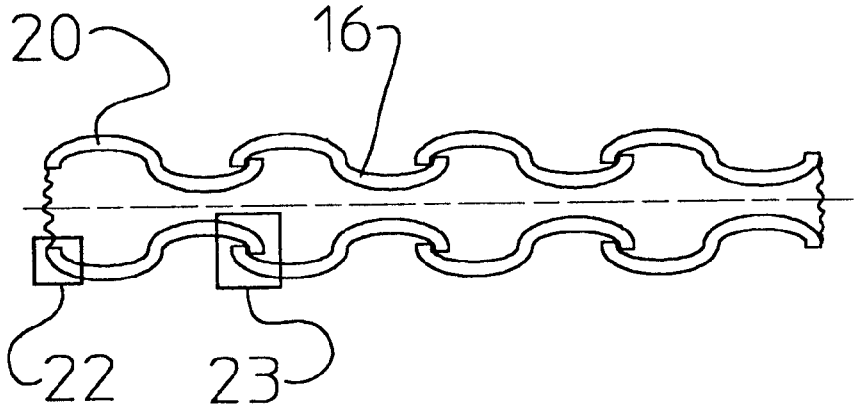
FIG. 2 is a partial cross sectional view taken along the linear centerline of an elongated flexible neck used therein.

Referring now in conjunction with FIG. 2, the elongated flexible neck 16 is linearly elongated in an extended fashion, and is form in a semi-pliable, fixable manner such as to allow the user the ability to articulate the head attachment end 17 in relation to the handle attachment end 18 fully about the lateral centerline of the handle 14. In this manner, the user can articulate the head 12 into a fixed position relative to the handle 14. Although it is envisioned that a variety of otherwise articulation means can accomplish the pliable articulation of the handle 14 and still remain in accordance with the teachings of the present invention, for purposes of disclosure of the best mode of the invention it is presently considered that a segmented metal gooseneck design for the neck 16 represents the present best mode of practicing the invention. In this manner, a series of segmented links 20 are linearly aligned, each having a concave portion 22 transitioning into a convex portion 23, thereby forming a generally "S" shaped cross section as indicated in FIG. 2. In this manner, the convex portion 23 of each segment can fit within and be retained by the concave portion 22 of the adjacent segment 20, in a rotatable, pivotable manner, thus allowing the entire flexible neck 16 to be urged into one of a number of articulated positions for allowing directional positioning of the head 12 relative to the handle 14.

Figure 3:
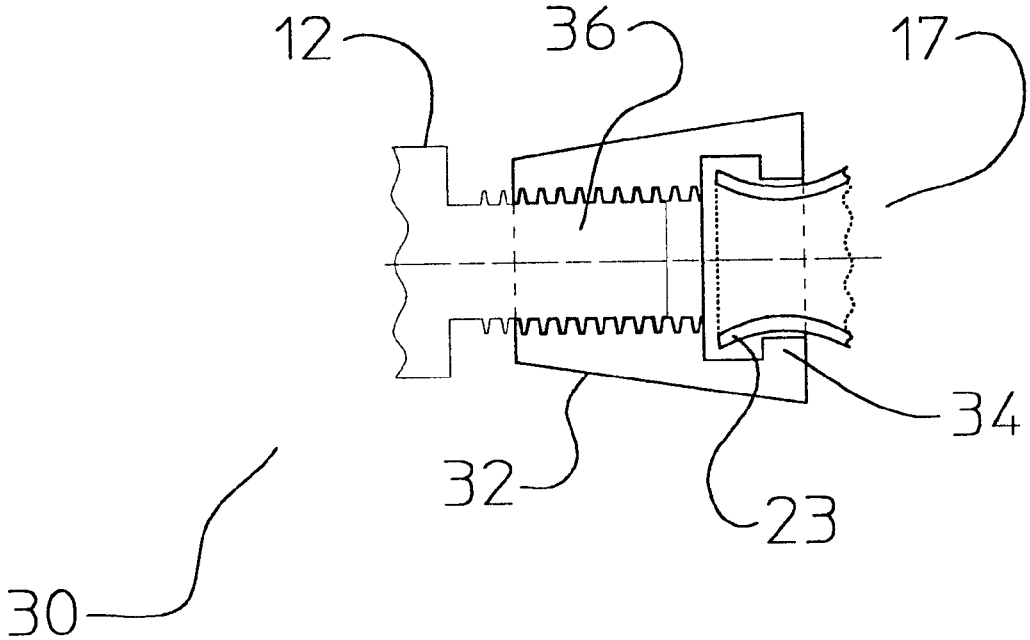
FIG. 3 a partial cross sectional view taken along the linear centerline of a head portion used therein.

FIG. 3 shows the attachment of the head 12 to the head attachment end 17 via a head attachment means 30. Although it is envisioned that a variety of attachment means can accomplish the attachment of the head 12 to the handle 14 and still remain in accordance with the teachings of the present invention, for purposes of disclosure of the best mode of the invention it is presently considered that an attachment coupling 32 is used having an inside gripping ridge 34 formed about the internal circumference of the coupling 32 at one end opposite a female thread 36 formed on the inside internal circumference of the coupling 32 opposite thereof. In this manner, the convex portion 23 of the final segment 20 can fit within and be retained by the inside gripping ridge 34. A male threaded attachment end 36 terminating the connection end of the head 12 can firmly and releasably connect with the female thread 36.

2. Operation of the Preferred Embodiment

To use the present invention, it is envisioned that a replaceable, disposable razor element can be attached to the head 12 using existing, otherwise conventional technology. The head 12 is then aligned with the coupling 32 and threaded until the base of the head 12 impinges firmly against the first segment 20. In this manner, the head 12 will not freely rotate about the neck 16. The neck 16 is then articulated into the shape desired, allowing the handle 14 to be positioned relative to and extended from the head 12. The user would simply apply shaving cream or gel, and begin shaving.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A reaching razor comprising:

a head portion;

a handle;

an elongated, flexible neck having a head attachment end opposite a handle attachment end, wherein said head portion is affixed to the head attachment end and said handle is attached to said handle attachment end, wherein said elongated flexible neck is linearly elongated in an extended fashion, and is formed in a semi-piable, fixable manner such as to allow a user the ability to articulate the head attachment end in relation to the handle attachment end fully about the lateral centerline of the handle wherein said elongated neck comprises a segmented metal gooseneck design having a series of segmented links, each linearly aligned, each having a concave portion transitioming into a convex portion, thereby forming a generally "S" shaped cross section such that the convex portion of each link can fit within and be retained by the concave portion of the adjacent segmented link in a rotatable, pivotable manner; and a head attachment means including an attachment coupling having an inside gripping ridge formed about the internal circumference of the coupling at one end opposite a female thread formed on the inside internal circumference of the coupling opposite thereof, whereby the convex portion of a final segmented link can fit within and be retained by the inside gripping ridge.

* * * * *